United States Patent [19]

Slywka

[11] 4,117,982

[45] Oct. 3, 1978

[54] ASBESTOS DELUMPER

[75] Inventor: Michael Slywka, Parma, Ohio

[73] Assignee: The Gibson-Homans Company, Cleveland, Ohio

[21] Appl. No.: 799,471

[22] Filed: May 23, 1977

[51] Int. Cl.[2] ..... B02C 23/26

[52] U.S. Cl. ..... 241/51; 241/55; 241/73

[58] Field of Search ..... 241/49, 51, 55, 73, 241/101 A

[56] References Cited

U.S. PATENT DOCUMENTS

| | | | |
|---|---|---|---|
| 2,145,728 | 1/1939 | Mankoff | 241/55 |
| 2,291,815 | 8/1942 | Korum | 241/51 |
| 3,547,358 | 12/1970 | Anderson et al. | 241/73 |
| 3,771,733 | 11/1973 | Hadley et al. | 241/73 |

*Primary Examiner*—Granville Y. Custer, Jr.
*Attorney, Agent, or Firm*—McNenny, Pearne, Gordon, Gail, Dickinson & Schiller

[57] ABSTRACT

Material conditioning apparatus particularly suited for disjoining compacted asbestos comprising a closed system in which material on a loading platform is manually fed into a delivery chute, directed by the chute to an agitating zone, and released upon adequate agitation through an outlet. Escape of airborne particulate matter from the system is avoided by delivery of material in a path generally tangential to an area of retreating blade movement, and control of air pressure and flow by means of an air inlet vent in the delivery chute.

4 Claims, 5 Drawing Figures

ASBESTOS DELUMPER

BACKGROUND OF THE INVENTION

The invention relates to material processing equipment, and in particular to apparatus for disjoining compacted material.

PRIOR ART

Particulate bulk material in the form of powders, fibers, and the like, often must be disjoined and otherwise conditioned before it may be efficiently used or processed. Such bulk materials may be deliberately compacted for purposes of efficient storage, shipping, and handling. In certain circumstances, for instance in bulk storage, such material may be naturally compacted by its own weight. Where particulate material is to be mixed with other materials, coated, sprayed, blown or otherwise dispersed, such operations are greatly facilitated if it is first disjoined by mechanical agitation.

Asbestos is a particulate material widely used in a myriad of composite materials and processes. In commercial use, asbestos is commonly compacted into blocks or cakes and contained in bags for handling, storing, and shipment. The degree of compaction and self-affinity of this material is such that when released from a bag it does not readily become disjoined, but must often be agitated either manually or by machine. There has accordingly existed a need for mechanical apparatus capable of efficiently disjoining compacted particulate material, such as asbestos, in various commercial fields. An important requirement of such apparatus is that it avoid dispersement of airborne particles into the atmosphere for reasons of health, safety, and general plant cleanliness.

SUMMARY OF THE INVENTION

The invention provides apparatus for disjoining and otherwise conditioning compacted particulate material in an efficient manner, while simultaneously avoiding dispersal of airborne particles into the surrounding atmosphere. More particularly, the apparatus provides a substantially closed system having means for mechanically agitating particulate matter and provisions for the introduction of successive charges of such matter into the system without escape of airborne particles. Ideally, this dustless feeding of successive material charges into the system is accomplished by a feed gate and cooperating air flow regulating means.

The disclosed apparatus is adapted to receive manually loaded compacted material on a platform. From this loading platform, material is directed through a gate and an enclosed chute to an agitating chamber. The gate opens to accept material to be processed and automatically closes to prevent reverse flow of airborne particles. During periods in which the gate is open, vent means in the delivery chute prevents the buildup of a positive pressure in the chamber or chute, which would otherwise tend to expel dust through the open gate. Additionally, the disposition of the vent and its geometrical relation to the various elements of the apparatus allow an air flow to be induced therethrough by operation of agitating means in the chamber and any draft operating at an outlet of the chamber, which is effective to entrain airborne particles away from the feed gate.

DESCRIPTION OF THE PREFERRED EMBODIMENT

Figure 1:
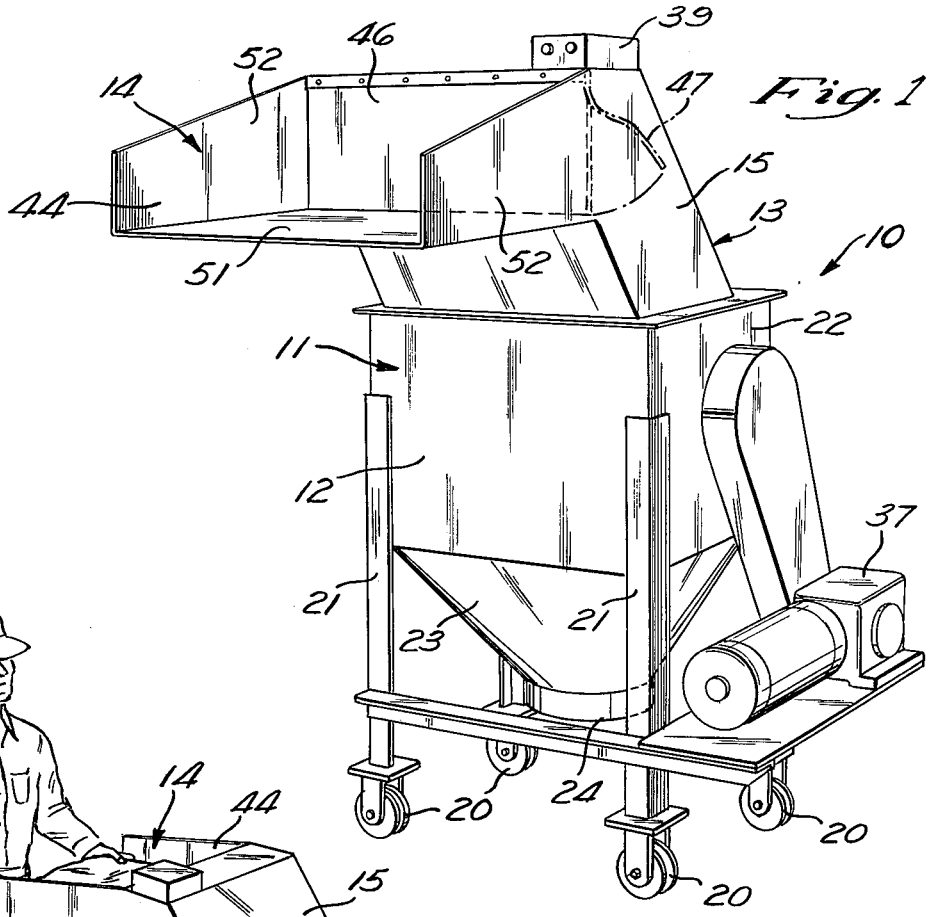
FIG. 1 is a front perspective view of apparatus constructed in accordance with the present invention.
Figure 2:
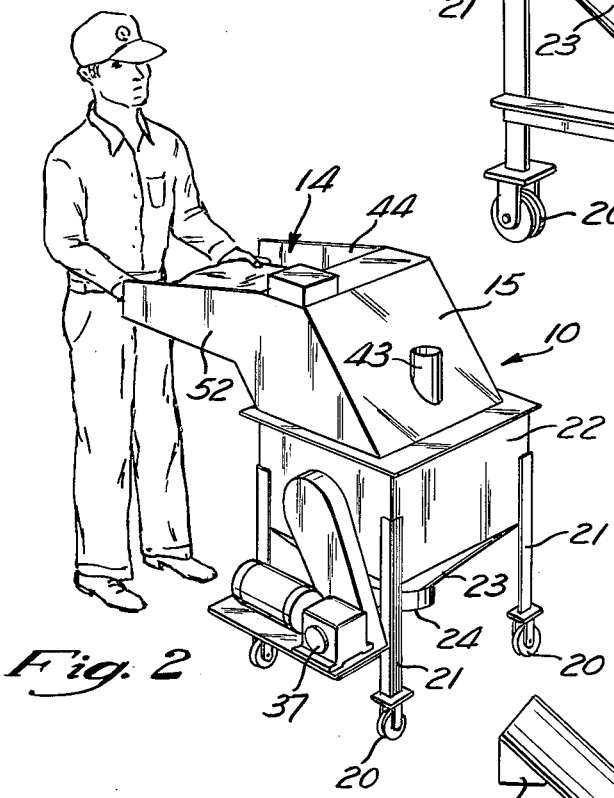
FIG. 2 is a rear perspective view of the apparatus.

Apparatus 10 constructed in accordance with the present invention includes a housing formed of a lower section 11 enclosing an agitator chamber 12 and an upper section 13 comprising a loading station 14 and a delivery chute 15. The walls of both of the housing sections 11 and 13 are generally imperforate and are preferably fabricated of steel sheet stock by welding and other known techniques. The upper housing section 13 is removably fixed to the lower section 11 at a horizontal plane defined by peripheral flange edges 18 and 19 on the lower and upper housing sections 11 and 13, respectively, to allow access to the agitator chamber 12 for purposes of maintenance.

The lower housing section 11 is supported by depending legs 21 of angle iron welded or otherwise fixed to the section. Where desired, the legs 21 are supported on casters 20 which, in the illustrated example, are grooved for operation on floor-mounted tracks.

Figure 4:
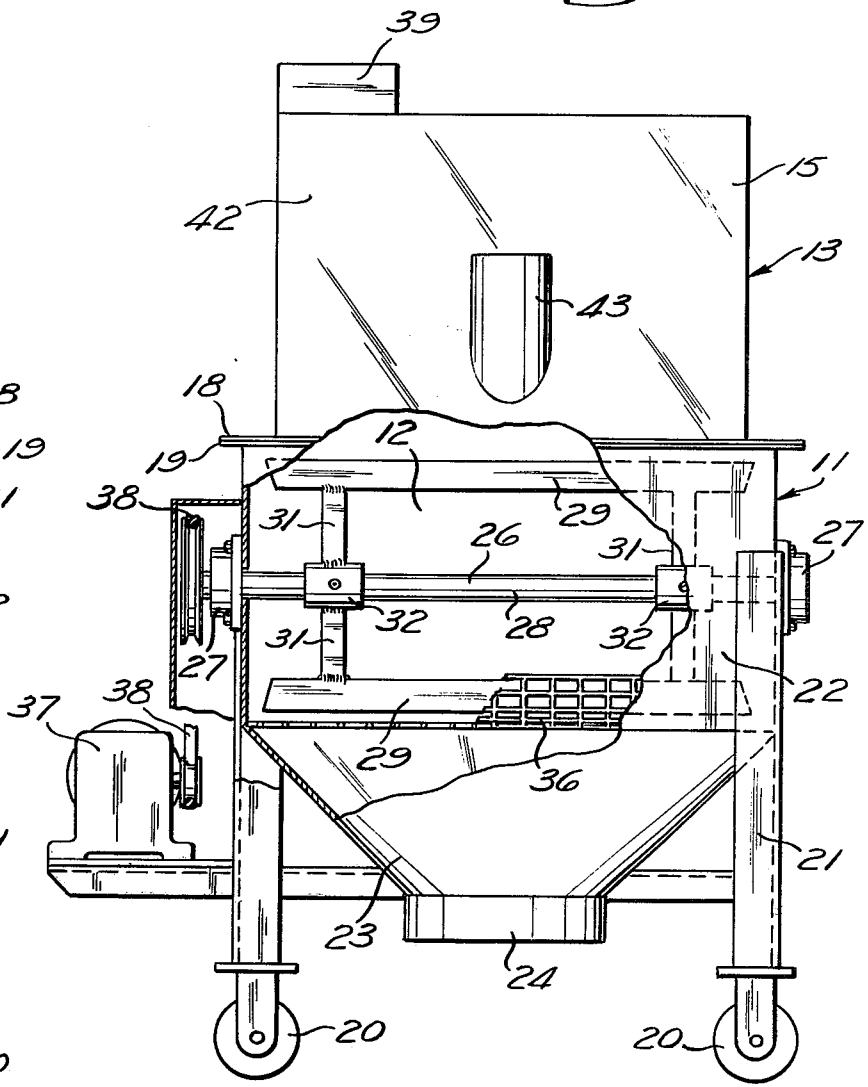
FIG. 4 is a view, partially broken away, taken from the rear of the apparatus.
Figure 3:
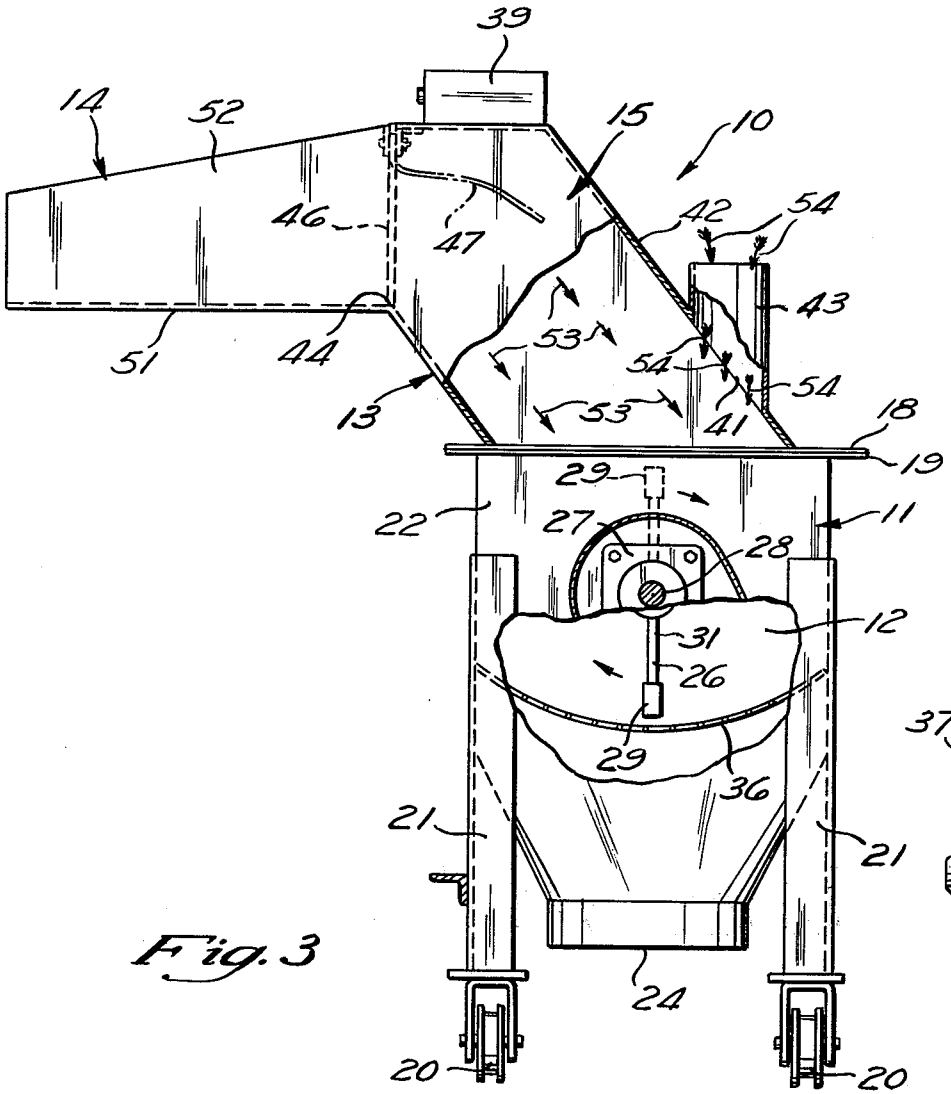
FIG. 3 is a side view of the apparatus.

With particular reference to FIGS. 3 and 4, the lower housing section 11 comprises a boxlike main body 22 and a funnel-shaped lower side or face 23 provided with a central circular outlet 24 immediately above floor level. An agitator 26 is rotatably supported in the chamber 12 by flange-mounted bearings 27 bolted to opposite outer faces of the walls of the chamber box 22. A central agitator shaft 28 extends through suitable holes in the body sidewalls into the bearings 27 for rotative support about a horizontal axis. The illustrated agitator 26, having the form of a paddle wheel, includes a plurality of horizontal, generally radially oriented blades 29. In the illustrated example, two diametrally opposite blades 29 are shown. The blades 29 are supported on the shaft 28 by spokes 31 welded or otherwise fixed to bushings 32 through which the shaft 28 extends. Lock screws or other appropriate means releasably secure the bushings 32 to the shaft 28.

A rigid grate 36 is fixed by welding or other means between the chamber box 22 and the funnel outlet 23. The grate or apertured wall 36 has an arcuate cross section described by a cylindrical segment spaced radially outward of the path of the outer tips of the blades 29. The grate 36 has openings, uniformly spaced across its area, of a size suitable for the particular material to be processed by the apparatus 10. Where the apparatus 10 is used for disjoining asbestos fibers, for example, the grate openings are preferably square, with a nominal aperture size of approximately 15/16 inch square.

The agitator 26 has a nominal major diameter, measured at the blade tips, of approximately 14 inches. The agitator 26 is rotatably driven by a gear motor unit 37 through a belt drive 38 at a rotational speed of approximately 45 rpm. The direction of rotation of the agitator 26 is clockwise as viewed in FIG. 3. The gear motor 37 is preferably an electrically driven unit, and is manually controlled by switches disposed in a box 39 conveniently arranged on an upper area of the delivery chute 15.

As shown, the delivery chute 15, having the form of a short tube of generally rectangular cross section, encloses substantially the full area of the upper face of the lower housing section 11 within the respective housing flange 18. The chute 15 is inclined upwardly and forwardly from the lower housing section 11 towards the loading section 14. On a rearward inclined face 42 of the chute 15, there is an inlet vent in the form of an aperture 41 cut into this chute face and a cylindrical tube 43 welded to the face. As indicated, the center of the inlet vent 43 is disposed rearwardly (to the right in FIG. 3) of an imaginary vertical plane passing through the axis of rotation of the agitator shaft 28.

The upper end of the chute 15 has a rectangular opening or entrance 44. The opening 44 is closed by a gate or door 46 in the form of a flexible panel of elastomeric material. The gate 46 is secured by screws or the like along its upper horizontal edge to the adjacent area of the chute 15 and operates in the manner of a living hinge, allowing it to swing inwardly to admit material into the chute. The open position of the gate 46 is indicated in phantom at 47.

The loading station 14 is integrally formed, as by welding, with the delivery chute 15, and includes a generally horizontal loading platform 51 and opposed vertical panels 52 at each side of the platform, serving to support the platform and guide material into the chute. The housing sections 11 and 13 and legs 21 are dimensioned to support the platform 51 at mid-torso height, for example, approximately 34 inches from the ground, to facilitate manual loading of material onto it and manual feeding of such material by pushing it rearwardly through the gate 46. As used for purposes of explanation herein, the rearward direction is considered the general horizontal direction in which material is fed across the platform 51 into the chute 15.

The disclosed apparatus 10 is particularly suited for disjoining or delumping asbestos or other similar particulate material. A common practice in process plants is to provide an elevated platform or floor over a mixing chamber, and to introduce material into the chamber through a hole in this elevated floor. In such situations, the central outlet 24 of the apparatus 10 is disposed over this floor hole. The contents of a sack or other measure are positioned, ordinarily by manual labor, on the platform 51. This charge of material is thereafter manually forced against the gate 46 to open it and cause the material to spill rearwardly and downwardly through the chute 15.

Material passing by gravity feed through the chute 15 toward the agitator chamber 12 is directed by the chute generally towards the area of the agitator 26, where the blades 29 are retreating relative to the material inlet or entrance 44. This flow of material is indicated by arrows 53. The rotation of the blades 29 thereby tends to capture falling material and direct it towards the grate 36, so that substantially no material is centrifugally thrown back towards the material inlet 44. Disjoined particles escape the agitator box 22 through the grate 36 and are released by falling through the funnel outlet 24.

It has been found that the addition of the inlet vent 43, which is exposed to atmospheric pressure at its outer end, by regulating air pressure and flow within the chute 15, greatly diminishes any tendency of airborne particulate matter in the chute or chamber 12 to flash back through the entrance 44 when the gate 46 is opened, as when a new charge of material is being fed. This apparently is the result of the inlet vent 43 preventing a pressure greater than atmospheric pressure to exist in the chute 15. Another explanation of this result is that the vent 43 allows continuous air flow, indicated by arrows 54, through the chute 15 and chamber 12. Such air flow is induced by rotation of the agitator 26 and relative geometry of the inlet vent 43, which is disposed over an area of blade travel where the agitator blades 29 are retreating and tending to draw a slight vacuum in their trail. Another source of air flow through the inlet vent 43 is a slight draft applied at the funnel outlet 24 both by the hole that it overlies, which transmits draft created within a mixer disposed beneath this hole and, by entrainment of air as disjoined material, falls through the outlet.

It should be understood that where the apparatus 10 overlies a hole through which a mixer or other device is fed, ordinarily other particulate materials not requiring agitation or disjunction may be simply poured through the apparatus, thereby avoiding effort otherwise expended in moving the machine away from the feeding hole. Where it is desirable that certain materials not be introduced through the apparatus 10, the apparatus is readily moved laterally from an underlying hole by travel on the casters 20.

Figure 5:
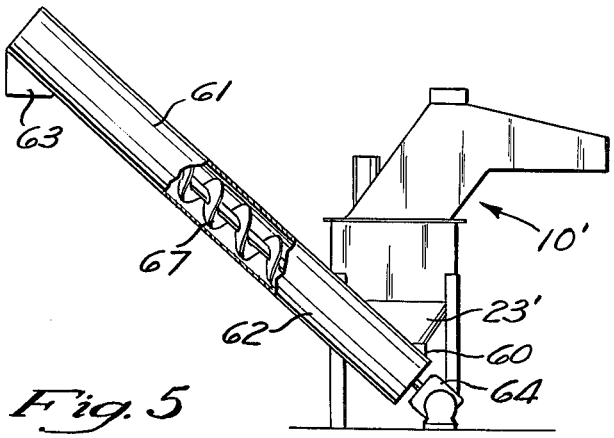
FIG. 5 is a side elevational view of a modification of the apparatus.

Referring now to FIG. 5, there is illustrated a modification suitable for use where material processed in the apparatus is required at a point elevated and/or remote from the discharge funnel. In FIG. 5, parts of the modified apparatus 10' identical with the parts of the above-described apparatus are indicated with the same numerals. In this modified apparatus 10', a discharge funnel 23' is altered to mate in dust-tight relation to a side inlet port 60 of a screw conveyor 61. The conveyor 61 comprises an elongated, cylindrical tube 62, which in the illustrated case is inclined to raise its outlet, designated 63, substantially above ground level. A gear motor 64 at an end of the tube 62 adjacent its inlet 60 is suitably coupled to rotatably drive a screw 67 extending along the full length of the interior of the tube. In a well known manner, rotation of the screw 67 carries material along the tube 62 until it reaches the outlet 63 and drops out of the tube under the influence of gravity.

Although a preferred embodiment of this invention is illustrated, it is to be understood that various modifications and rearrangements of part may be resorted to without departing from the scope of the invention claimed herein.

What is claimed is:

1. Apparatus for disjoining compacted asbestos and like material, comprising a generally closed housing, an entrance at an upper portion of one face of the housing for passage of compacted material therethrough into the housing, an agitation zone within the housing communicating with the entrance, means in the agitation zone for mechanically disjoining compacted material, a discharge opening in the housing underlying the agitation zone for releasing material disjoined by said mechanical disjoining means from the housing, an air inlet in the housing overlying said agitation zone, said air inlet being generally between said material entrance and said agitation zone, whereby discharge of material and air through said discharge opening is adapted to induce air flow into said housing through said inlet and prevent escape of airborne particulate matter through said material entrance.

2. Apparatus as set forth in claim 1, wherein said mechanical disjoining means comprises a paddle wheel agitator having a horizontal axis of rotation and generally radially oriented blades, said paddle wheel being arranged to rotate in a direction such that in a zone adjacent said air inlet said blades retreat away from said air inlet.

3. Apparatus as set forth in claim 2, including a gate for sealing said entrance, enclosure means for directing material under gravity feed downwardly and rearwardly from the entrance to the agitating zone along a path generally towards a side of the paddle wheel agitator where said blades are moving in a retreating direction whereby material tends to be drawn in a direction away from said entrance.

4. Apparatus for disjoining compacted material, comprising a housing providing a material loading station, a delivery chute, and an agitating chamber, said material loading station including a generally horizontal platform supported by the housing at mid-torso height, an opening in the delivery chute immediately adjacent the loading platform, means sealing said opening and adapted to swing into said chute to admit material therein from said platform when such material is manually moved in a horizontal rearward direction, a paddle wheel agitator in said agitating chamber, said agitator having a horizontal axis of rotation lying in a plane transverse to said rearward direction and blades moving in a circular path about said axis, said chamber including an aperture bottom wall adapted to release disjoined material from said chamber and to retain compacted material therein, means defining a material outlet at a lower face of said housing, an air inlet in said chute, said chute being arranged to guide material along a feed path from said platform rearwardly and downwardly to said agitating chamber, said feed path being generally tangential to the path of the agitator blades, power means fixed relative to said housing for rotating said agitator in a direction causing movement of said blades in generally the same direction as material moving along said tangential feed path, said vent being disposed above said agitator and generally rearwardly of a vertical plane passing through said agitator axis, said vent normally preventing a positive pressure above atmospheric pressure from existing in said chute and allowing a downward air flow therethrough into and through said chute and agitating chamber to be induced by rotation of said agitator and/or a negative pressure at said outlet, thereby avoiding a tendency of said airborne particulate matter in said chute and chamber to escape forwardly through said opening.

* * * * *